US005904589A

United States Patent [19]

Asakawa

[11] Patent Number: 5,904,589

[45] Date of Patent: May 18, 1999

[54] FLAT CABLE CONNECTOR

[75] Inventor: Kazushige Asakawa, Yokohama, Japan

[73] Assignee: The Whitaker Corporation, Wilmington, Del.

[21] Appl. No.: 08/886,636

[22] Filed: Jul. 1, 1997

[51] Int. Cl.[6] ..... H01R 9/07

[52] U.S. Cl. ..... 439/495; 439/496

[58] Field of Search ..... 439/495, 496

[56] References Cited

U.S. PATENT DOCUMENTS

| | | | |
|---|---|---|---|
| 3,989,336 | 11/1976 | Rizzio, Jr. et al. | 339/74 R |
| 4,252,393 | 2/1981 | Johnson | 339/75 MP |
| 4,519,133 | 5/1985 | Pansanel | 29/863 |
| 4,629,271 | 12/1986 | Awano | 339/75 MP |
| 4,768,969 | 9/1988 | Bauer et al. | 439/260 |
| 4,995,829 | 2/1991 | Geib et al. | 439/409 |
| 5,012,078 | 4/1991 | Pernet | 235/441 |
| 5,074,797 | 12/1991 | Yamada | 439/62 |
| 5,145,381 | 9/1992 | Volz | 439/62 |
| 5,161,992 | 11/1992 | Birch | 439/260 |
| 5,201,661 | 4/1993 | Ii | 439/79 |
| 5,240,430 | 8/1993 | Soes | 439/260 |
| 5,308,262 | 5/1994 | Chishima | 439/495 |
| 5,370,552 | 12/1994 | Chishima et al. | 439/495 |
| 5,401,186 | 3/1995 | Nozaki et al. | 439/495 |
| 5,470,246 | 11/1995 | Mosquera | 439/260 |
| 5,498,169 | 3/1996 | Ikemoto | 439/260 |
| 5,501,610 | 3/1996 | Ikemoto | 439/498 |
| 5,542,855 | 8/1996 | Asai | 439/260 |
| 5,580,272 | 12/1996 | Yamaguchi et al. | 439/495 |
| 5,613,866 | 3/1997 | Niimura | 439/260 |
| 5,639,260 | 6/1997 | McHugh | 439/495 |

FOREIGN PATENT DOCUMENTS

| | | | |
|---|---|---|---|
| 3-266384 | 11/1991 | Japan | H01R 23/66 |
| 5-32945 | 8/1993 | Japan | H01R 13/639 |
| 5-251140 | 9/1993 | Japan | H01R 23/68 |

*Primary Examiner*—Steven L. Stephan
*Assistant Examiner*—Jean F. Duverne
*Attorney, Agent, or Firm*—Anton P. Ness

[57] ABSTRACT

Flat cable connector 10 having numerous flat-plate-form contacts 30 in an insulating housing 20. Each contact 30 has a first arm 33 and a second arm 34coextending forwardly from a base part 31 so that the two arms are substantially parallel to each other. A contact point 35 is formed proximate the free end of the first arm 33, and an engaging projection is formed on the free end of the second arm 34 that protrudes beyond the front surface 23 of the insulating housing 20 The end portion of the flat cable 50 inserted between the arms 33 and 34is pressed by pushing the tongue part 42 of the slider 40inward so that a contact pressure is applied between the contact points 35 and the conductors of the flat cable 50Furthermore, the slider 40 is fastened to the insulating housing 20 via the contacts 30 by the latching engagement of an engaging recess 47 with the engaging projections 36.

1 Claim, 3 Drawing Sheets

FLAT CABLE CONNECTOR

FIELD OF THE INVENTION

The present invention concerns an electrical connector, and specifically concerns an electrical connector for flexible flat cables or flexible circuit boards (both of which are hereafter referred to collectively as "flat cables").

BACKGROUND OF THE INVENTION

Flat cables were developed for use in the transmission of relatively low-frequency digital or analog signals, and are widely used in various types of electronic devices and devices using electronics In particular, since flat cables are extremely thin, such cables are superior in terms of the space factor obtained; furthermore, since flat cables also have good flexibility, such cable are suitable not only for compact, high-density connections but also for mutual connections between movable parts and fixed parts.

Flat cable connectors also include vertical type connectors that have an insulating housing and contacts that are perpendicular to the circuit board; however, horizontal type connectors that utilize the compact, high-density characteristics of flat cables are more common. For example, applications are common in which a pair of flat cable connectors are connected to both ends of a flat cable, and this cable is used to connect two circuit boards that are parallel to each other or positioned in an arbitrary angular relationship.

Common conventional examples of such horizontal type flat cable connectors are described in (for example) Japanese Utility Model Application Kokoku No. 5-32945, Japanese Patent Application Kokai No. 3-266384 and Japanese Patent Application Kokai No. 5-251140.

In such conventional flat cable connectors, beam-form contacts or contacts having the shape of a tuning fork with one elastic arm are fastened parallel to each other in a row along an opening formed in an insulating housing. One end of the flat cable is inserted into this contact row via the opening in the insulating housing. Furthermore, since flat cables are extremely thin and flexible, a reinforcing plate is ordinarily attached to one end of the flat cable on the opposite side from the conductors in order to endow the cable with some rigidity. However, stable contact with a sufficient contact pressure between the respective conductors of such a flat cable and the contacts of the connector cannot be obtained merely by inserting one end of the flat cable into the opening formed in the insulating housing. Generally, therefore, it is necessary to insure a sufficient contact pressure by press-fitting a slider made of an insulating plastic inside the opening so that the conductors of the flat cable are pressed against the contacts by the tongue part of this slider.

A typical example of such a conventional flat cable connector will be described in further detail with reference to FIGS. 4(A) and 4(B). Here, the flat cable connector 1 has a relatively thin rectangular insulating housing 2, and contacts 4 that have two arms are fastened by press-fitting from the rear end of the connector inside contact receiving holes 3 that pass completely through the connector from the front end to the rear end. The leading end portion of a flat cable 5 is inserted between the arms of the respective contacts 4 via an opening in the front surface of the insulating housing 2. Furthermore, a slider 6 having a tongue part is pushed in from the front surface of the insulating housing 2, so that the conductors of the flat cable 6 are pressed against the contacts 4 by the tongue part.

Here, as is clear from FIG. 4(A), it is necessary that the slider 6 be securely anchored inside the insulating housing

2 after insertion so that contacts 4 constantly maintain an appropriate contact pressure against the conductors of flat cable 5. For this reason, it is necessary to dispose latching arms and engaging parts between the sides of slider 6 and the facing insulating housing 2 so that both parts are fastened by latching. As is clear from FIG. 4(A), such latching parts occupy a considerable portion of the overall width of the insulating housing 2. This is also true in the conventional examples mentioned above. When the number of conductors in the flat cable is increased so that the width of the flat cable is increased, the area occupied by the latching parts becomes smaller in relative terms; however, in view of the strong demand for light weight, thinness and compactness in recent electronic devices, the area occupied by such latching parts cannot be ignored.

Furthermore, in the case of Japanese Patent Application Kokai No. 5-251140 mentioned above, a flat cable is split into a plurality of flat cables, and a connector module is formed for each of these flat cables. Latching parts are formed on sliders for each module, and a flat cable connector is obtained in which latching engagement is accomplished by means of a plurality of latching arms formed by a metal cover that accommodates a plurality of modules. However, as a result of such modularization, a certain amount of dead space is unavoidably created between the modules, so that an increase in density is hindered

SUMMARY OF THE INVENTION

Accordingly, the flat cable connector of the present invention provides a compact, high-density flat cable connector that makes it possible to connect flat cables with a larger number of conductors in a given space by eliminating the extra space required for latch fastening of the slider to the insulating housing, with latching of the slider with the housing achieved by at least some of the contacts.

Preferably, each contact has a pair of arms formed roughly in the shape of a tuning fork; a contact point is formed on the free end of one of these arms, while the other arm is lengthened and caused to extend forward of the insulating housing, with an engaging projection being formed on the free end. The slider has a tongue part that is interposed between the arms of the contacts, and an operating part. An engaging recess that latchingly engages with the engaging projections of the contacts, is formed in the transition area between the operating part and the tongue part of the slider.

In a preferred working configuration of the present invention, the respective contacts are flat plate-form contacts that are press-fitted into respective passages from the rear surface of the insulating housing, and that have solder tails for surface mounting (SMT). However, these contacts may also be contacts of the type that have soldering posts insertable into plated through-holes of a circuit board and soldered.

An embodiment of the invention will now be described by way of example with reference to the accompanying drawings.

BRIEF DESCRIPTION OF THE DRAWINGS

With reference to FIG. 1, the flat cable connector 10 is constructed from an insulating housing 20 that has a low-back structure (generally formed from an insulating plastic material), a slider 40 and a plurality of contacts 30 that are fastened inside the insulating housing 20 by press-fitting into respective contact receiving passages 25 toward the front surface 24 (i.e., the surface from which the flat cable is inserted) from the rear surface 23 between a top wall 21 and a bottom wall 22. As is seen from FIG. 1, passages 25 have the form of long, narrow slots oriented in the vertical direction in approximately the rear half of the insulating housing 20, but are formed as recesses (or cavities) 26 that communicate with each other in the lateral direction in the front half of the insulating housing 20.

Figure 1:
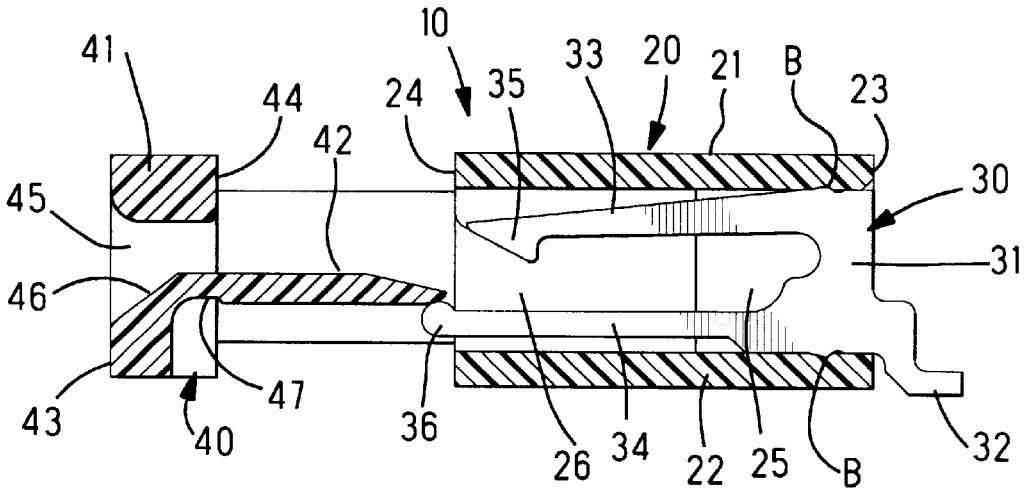
FIG. 1 is a longitudinal section showing a preferred example of the flat cable connector of the present invention prior to the connection of the flat cable.

Contacts 30 are stamped from thin elastic metal plates, and have a plate form overall. Each contact 30 in the present example has a base part 31 that has barbs B formed on its upper and lower edge surfaces, a solder tail 32 that extends outward (rearward) and downward from the base part 31, and a first arm 33 and second arm 34 that extend forward from the base part 31 so that these arms are substantially parallel to each other. First arm 33 extends forward from the upper end of the base part 31 with a slight downward inclination, and has a contact point 35 that protrudes downward in the vicinity of the free end. The tip end of first arm 33 is positioned inside the corresponding recess 26 of the insulating housing 20 at a point located slightly inward from the front surface 24 of the insulating housing 20. On the other hand, second arm 34 is slightly separated from the inside surface of bottom wall 22 of insulating housing 20, and extends substantially parallel to bottom wall 22, with the free end of the second arm 34 protruding beyond front surface 24 of the insulating housing. A projection 36 is formed on the free end of second arm 34.

The slider 40 has an operating part 41 that is substantially rectangular in shape, and a tongue part 42 that extends rearward from operating part 41, and that is inserted between the first arms 33 and second arms 34 of the respective contacts 30 inside the recesses 26 of the insulating housing 20. A flat cable insertion opening 45 is formed in operating part 41 and passes through the operating part 41 from the front surface 43 to the rear surface 44. A taper 46 is formed in the front end of opening 45 in order to facilitate insertion of the flat cable. Furthermore, an engaging recess 47 is formed in the bottom surface of the part 42 and the base portion of the operating part 41 of the slider 40. As will be described later, engaging recess 47 enters into a latching engagement with the engaging projections 36 on the tip ends of the second arms 34 of contacts 30.

Figure 4A:
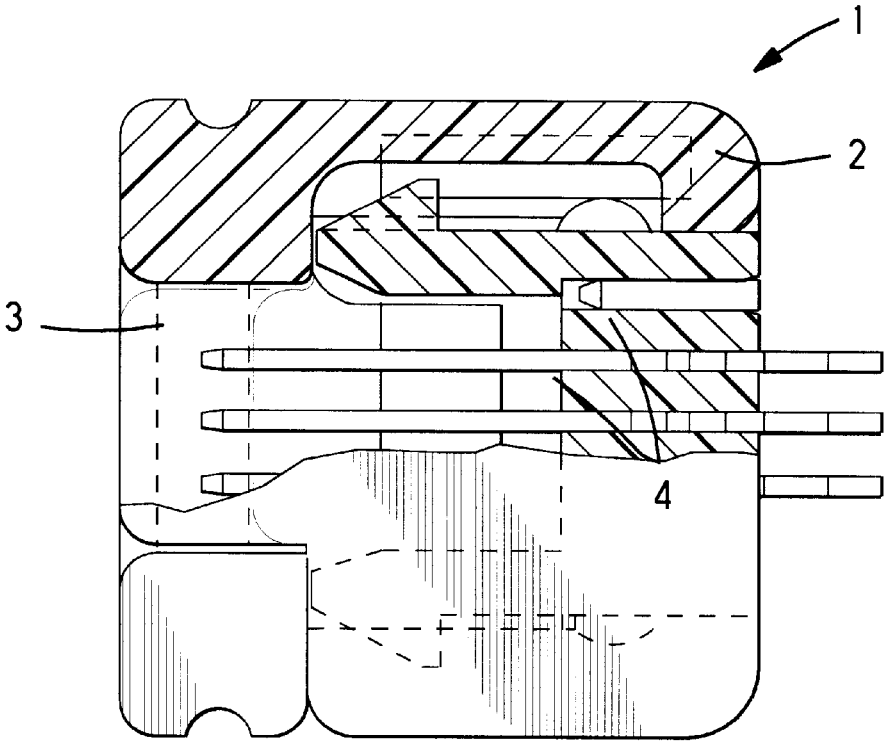
Fig. 4A PRIOR ART
FIGS. 4(A) and (B) are a plan view and a sectional view a conventional of a flat cable connector.
Figure 4B:
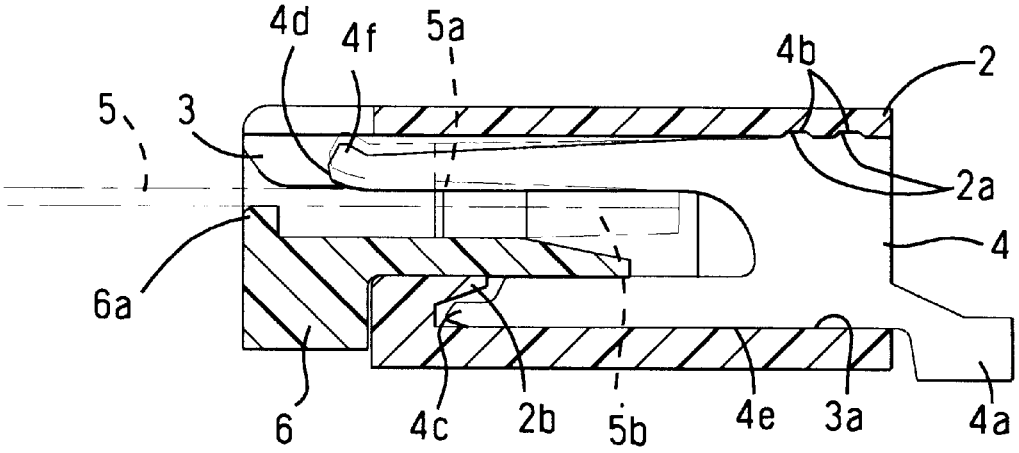
Fig. 4B PRIOR ART

As is seen from a comparison of the flat cable connector of the present invention shown in FIG. 1 with the conventional connector shown in FIG. 4, the flat cable connector 10 of the present invention has the following special features in terms of construction: first of all, the contacts 30 have a pair of arms 33 and 34, and the second arms 34 also have some degree of elasticity. Second arms 34 protrude forwardly beyond the front surface 24 of insulating housing 20, and have engaging projections 36 at their free ends. Secondly, the slider 40 has a simple structure without latching arms on either side; furthermore, the slider 40 has an engaging recess 47 in the base portion of tongue part 42. The connection operation of a flat cable connector possessing such special features in terms of construction will be described below with reference to FIGS. 2(A) through 2(D).

Figure 2A:
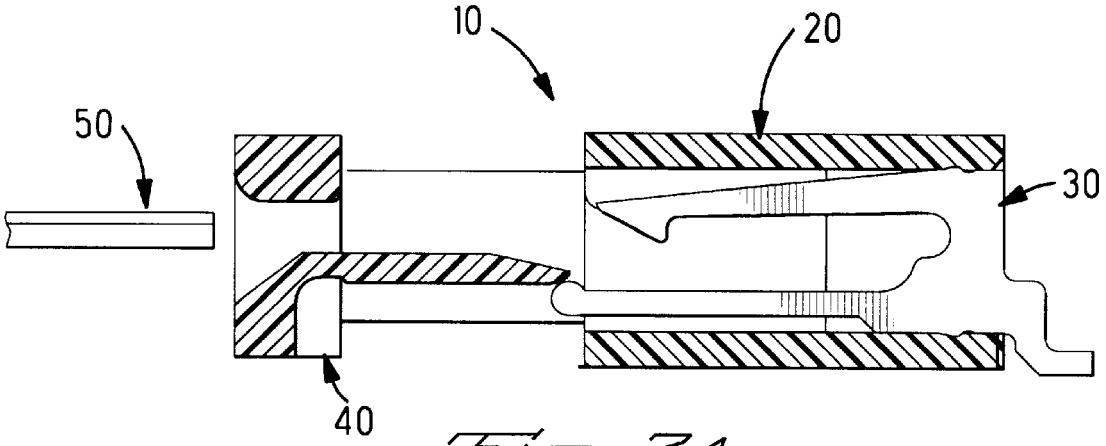
FIGS. 2(A) through 2(D) are sectional views illustrating a flat cable being connected to the flat cable connector shown in FIG. 1.

FIG. 2(A) shows the state prior to the connection of the flat cable 50 to the flat cable connector 10. The tip end of the tongue part 42 of slider 40 is positioned in the vicinity of the front ends of the second arms 24 of contacts 30. This is a state of rough alignment. In other words, the flat cable insertion opening 45 of the slider 40 and the recesses 26 of the insulating housing 20 are roughly aligned.

Figure 2B:
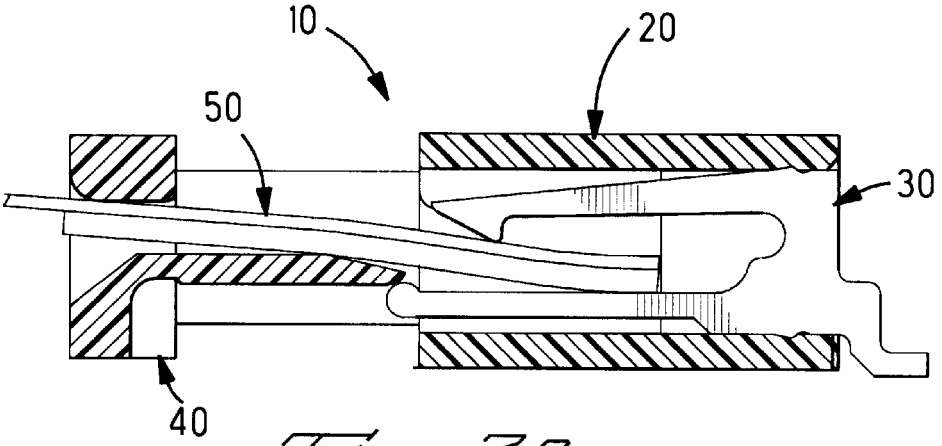

FIG. 2(B) shows a state in which the tip portion of the flat cable 50 has been inserted into the insulating housing 20 via the opening 45 in slider 40. In this case, the front end portion of the flat cable 50 can easily be pushed into the spaces between the first arms 33 and second arms 34 of contacts 30 inside insulating housing 20 by means of a light insertion force without meeting any substantial resistance.

Figure 2C:
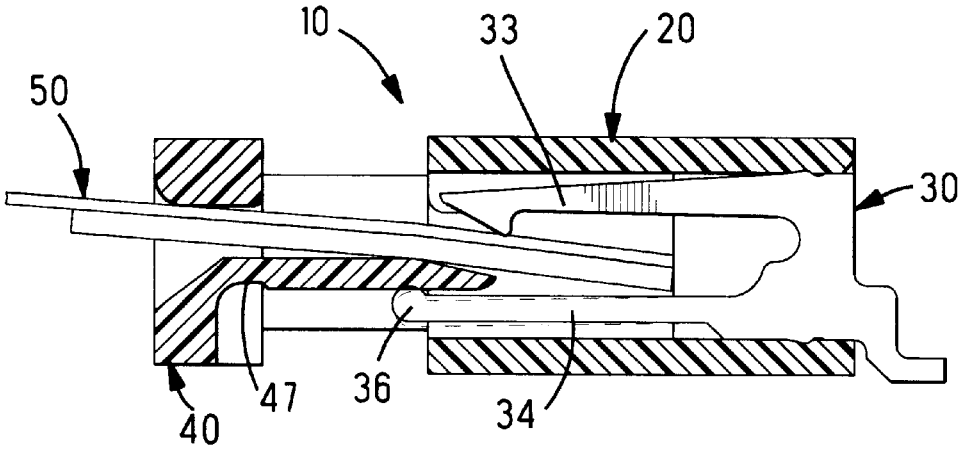

FIG. 2(C) shows a state in which the slider 40 has been pushed slightly into the insulating housing 20 from the state shown in FIG. 2 (B). Here, the tip end of the tongue part 42 of the slider 40 moves to the vicinity of the contact points 35 of the first arms 33 of contacts 30, and applies a slight contact pressure to the conductors of flat cable 50. In this case, the second arms 34 are deflected slightly downward as a result of the contact pressure between the engaging projections 36 and the tongue part 42 (see the broken line in FIG. 2 (C)).

Figure 2D:
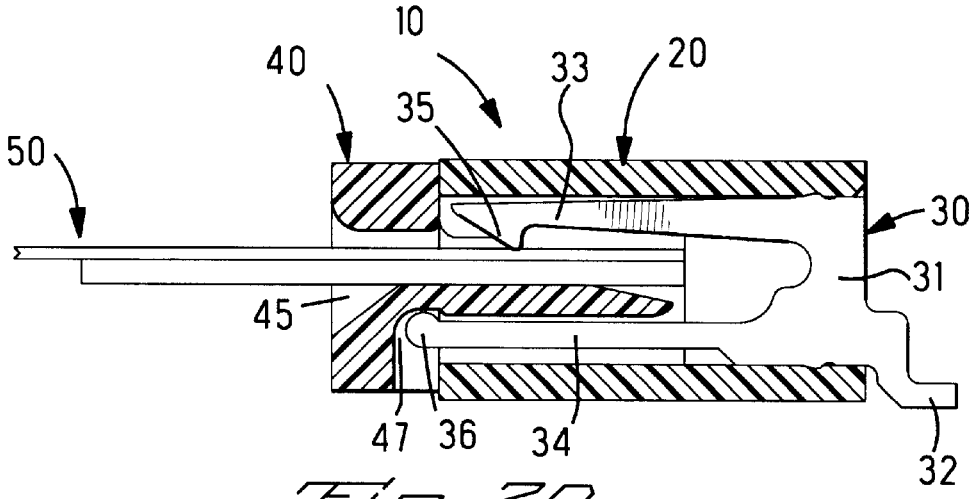

FIG. 2(D) shows a state in which flat cable 50 is completely connected to flat cable connector 10. Specifically, when slider 40 is pushed further into insulating housing 20 from the state shown in FIG. 2(C), the tongue part 42 is pushed completely into the spaces between the first arms 30 and second arms 34 of contacts 30, so that the conductors of flat cable 50 are stably connected to the contact points 35 of the first arms 33 by a sufficient contact pressure. In this state, furthermore, the engaging recess 47 of the slider 40 and the engaging projections 36 of the second arms 34 enter into a latching engagement, so that the slider 40 is fastened to the insulating housing 20 with a sufficient strength via the contacts 30. Accordingly, there is no need to form any special latching device or member that occupies a large area between the slider 40 and the insulating housing 20. As a result, the width of the insulating housing can be caused to approximate the width of the flat cable 50, so that a compact size and a high density can be achieved, and so that the space factor, that has been a problem in conventional connectors, can be improved.

The fastening between the slider 40 and the insulating housing 20 is made sufficiently strong so that the slider 40 will not move (slip out) from the insulating housing 20 under conditions of use (e.g., when tension is applied to the flat cable from outside). This strength is determined by the elasticity of the second arms 34, and by the shapes and dimensions of the engaging projections 36 and engaging recess 47. Furthermore, it is not essential that engaging projections 36 be formed on the second arms 34 of all of the contacts 30; it would also be possible to form such engaging projections 36 in an appropriate manner only on selected contacts 30 (e.g., contacts at both ends, contacts at both ends and at the center, or every other contact).

A preferred working configuration of the flat cable connector of the present invention was described in detail above. However, the present invention is not limited to such a specified construction; it goes without saying that various modifications and alterations may be made in the insulating housing, contacts and slider in accordance with the application of the connector.

Figure 3:
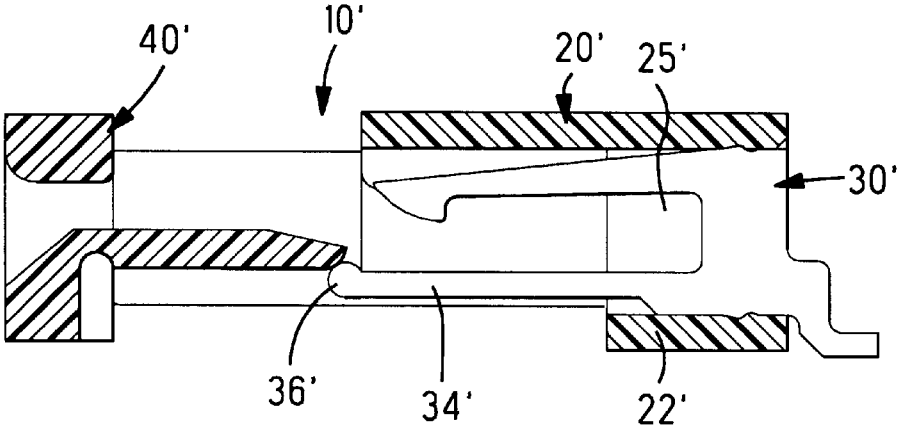
FIG. 3 is a sectional view (similar to FIG. 1) that illustrates a modification of the flat cable connector of the present invention.

FIG. 3 shows a modification of the flat cable connector of the present invention. Flat cable connector 10' is similar to flat cable connector 10 shown in FIGS. 1 and 2. The main point of difference is that the front portion of the bottom wall

22' of the insulating housing 20' is cut away beneath the contact receiving passages 25'. As a result, the permissible range of elastic deformation of second arms 34' of contacts 30' is increased upon slider engagement with engaging projections 36' on the free end portions. Consequently, the force required in order to push in or pull out the slider 40' can be reduced, so that deleterious effects caused by the application of an excessive force to the flat cable connector 10' when the connector is attached to a circuit board can be eliminated.

In the flat cable connector of the present invention, as is clear from the above description, the latch-fastening of the slider and insulating housing is accomplished indirectly via the contacts without any need to use a latching member for direct latch-fastening. Accordingly, the width of the insulating housing can be caused to approximate the width of the flat cable, so that the space factor can be improved. Accordingly, the flat cable connector of the present invention is suitable for use in electronic devices that require compactness, light weight and high-density packaging such as camcorders, mini-disks, portable telephones and the like. Furthermore, unlike the contacts in conventional horizontal type flat cable connectors, the contacts in the flat cable connector of the present invention have a pair of elastically deformable arms. Accordingly, since no excessive external force is applied during insertion or removal of the slider, the connection stability of the connector can be maintained.

What is claimed is:

1. A flat cable connector in which a plurality of parallel conductors at one end of a flat cable are inserted into a cable receiving cavity an insulating housing to be connected with a plurality of contacts held therein, with the conductors of the flat cable pressed against said contacts by a slider also inserted into the cavity, characterized in that:

said contacts each have a first arm that has a contact point in the vicinity of the free end, and a second arm that faces said first arm, with the second arms of at least some of said contacts being longer than said first arms and having an engaging projection in the vicinity of the free end, and said slider includes an engaging recess that engages with said projections for securing said slider in said cavity.

* * * * *